US005105508A

United States Patent [19]

Aebli et al.

[11] Patent Number: 5,105,508

[45] Date of Patent: * Apr. 21, 1992

[54] METHOD AND APPARATUS FOR THE OPENING OF FIBER FLOCKS FROM FIBER BALES

[75] Inventors: Jost Aebli; Daniel Hanselmann; Walter Schlepfer, all of Winterthur, Switzerland

[73] Assignee: Maschinenfabrik Rieter AG, Winterthur, Switzerland

[ * ] Notice: The portion of the term of this patent subsequent to May 29, 2007 has been disclaimed.

[21] Appl. No.: 514,433

[22] Filed: Apr. 25, 1990

[30] Foreign Application Priority Data

Apr. 26, 1989 [CH] Switzerland ..... 01589/89

[51] Int. Cl.[5] ..... D01G 7/10

[52] U.S. Cl. ..... 19/80 R

[58] Field of Search ..... 19/80 R

[56] References Cited

U.S. PATENT DOCUMENTS

| | | | |
|---|---|---|---|
| 3,135,022 | 6/1964 | Binder | 19/80 R |
| 4,035,869 | 7/1977 | Wilkes et al. | 19/80 R |
| 4,457,058 | 4/1984 | Binder et al. | 29/125 |
| 4,623,099 | 11/1986 | Vosbein et al. | 19/80 R X |
| 4,660,257 | 4/1987 | Binder et al. | 19/80 R |
| 4,678,128 | 7/1987 | Hergeth | 19/80 R X |
| 4,707,888 | 11/1987 | Binder et al. | 19/80 R |
| 4,780,933 | 11/1988 | Pinto et al. | 19/80 R |
| 4,796,335 | 1/1989 | Kranefeld et al. | 19/80 R |
| 4,827,572 | 5/1989 | Walk | 19/89 R |
| 4,928,354 | 5/1990 | Hanselmann et al. | 19/80 R X |

FOREIGN PATENT DOCUMENTS

| | | | |
|---|---|---|---|
| 0058781 | 9/1982 | European Pat. Off. | 19/80 R |
| 0193647 | 9/1986 | European Pat. Off. | 19/80 R |
| 0263965 | 4/1988 | European Pat. Off. . | |
| 0326913 | 8/1989 | European Pat. Off. | 19/80 R |
| 0327885 | 8/1989 | European Pat. Off. | 19/80 R |
| 1137359 | 9/1962 | Fed. Rep. of Germany . | |
| 3334222 C2 | 4/1986 | Fed. Rep. of Germany . | |
| 3643507 | 6/1988 | Fed. Rep. of Germany . | |
| 3274863 | 11/1988 | Japan | 19/80 R |

*Primary Examiner*—Werner H. Schroeder
*Assistant Examiner*—John J. Calvert
*Attorney, Agent, or Firm*—Burns, Doane, Swecker & Mathis

[57] ABSTRACT

A fiber bale opening device (1.1) with a bale opening organ (30) moves in the direction of the arrow A over a row of bales (4) to open fiber flocks from the surface of the bales by means of the opening rollers 6*a* and 6*b*. The opening rollers are inclined in such a way that the bales are opened with an angle γ to the horizontal. The opening rollers (6*a* and 6*b*) are moreover adjustable to incline in such a way that the depth of penetration (T.1) of the leading opening roller correspond substantially to half the penetration depth (T.2) of the trailing opening roller. These penetration depths can, on the one hand, be effected by the setting of the opening rollers. Movement of the opening organ (30) in direction (D) sets of the opening rollers in order to retain the opening depth (T.1).

20 Claims, 9 Drawing Sheets

METHOD AND APPARATUS FOR THE OPENING OF FIBER FLOCKS FROM FIBER BALES

FIELD OF THE INVENTION

The invention relates to methods and apparatus for opening bales of such fibers as cotton fibers, synthetic fibers and the like, and the removal of the flocks for processing. In particular, the invention is connected with fiber bale opening systems of the type in which a plurality of bales are arranged in a row and an opening head or organ having rotating opening rollers protruding from its lower end moves back and forth over the row to remove flocks from the tops of the bales.

BACKGROUND

A device with an opening organ for opening fiber bales with two rotating opening rollers is known from the German patent Specification DE-33 34 222 C2, with which the opening organ is moved to and fro over the surface of the fiber bales for opening the fiber flocks and with every passage penetrates into the fiber bale with a specified depth of penetration, in order to give the opening roller the opportunity to open fiber flocks from the surface, which are subsequently given over to a pneumatic removal and conveying system such as a hoisting shaft.

Further, it is known from West German Utility Patent No. 87 12 308.8, that with a previously described opening organ with two rotating rollers, instead of the horizontal passage of the opening rollers for opening fiber flocks from the surface of the fiber bales, the opening organ opens the fiber flocks in a direction of movement inclined to the horizontal from a correspondingly inclined surface of the fiber bales.

In opposition to the system described in the DE-33 34 222 in which the fiber bales are arranged in a stationary position, according to the description of the aforesaid utility patent, the fiber bales are moved to and fro on the conveyor against the opening organ, so that the opening organ always opens fibers from the inclined surface in the same movement region.

It is known in practice that with such double roller bale openers the rollers are contra-rotating, whereby seen in the direction of movement in each case, the front opening roller rotates with a so-called synchronism with the direction of movement, in order to open the fibers from the surface in this synchronism. The rear rollers, seen in the direction of movement, rotate correspondingly in the opposite sense and open the fiber flocks from the same surface in the contra-rotating cutting system.

It is now known, that the opening of fiber flocks in the aforesaid opposite sense has a lower opening efficiency from the point of view of quantity than a roller which turns in contra-rotation.

Likewise, an opening organ with an opening roller is known, in which the sense of rotation is reversible, so that the opening roller may be moved in the synchronous sense at all times.

With the known double roller arrangement, it is possible to open flocks with the two and fro passage of the opening organ without it being necessary to change the sense of rotation of the rollers, because the two oppositely rotating rollers can be rotated in such directions that, whichever roller is the leading roller when the head or organ is moving in a given direction, that roller will contact the bales with a directional component opposed to the direction of bodily movement of the head. That is, the front roller always rotates in synchronism directionally with the linear movement of the head as a whole. An increase in the opening performance, compared with the single roller opening organ mentioned, cannot really be attained however, because of the lower efficiency (with reference to quantity) of the contra-rotating opening roller.

An improvement of performance resides in the possibility of allowing both opening rollers to rotate in synchronism for each direction of movement. However, this implies that for the return passage of the rollers, an opposite sense of rotation is given or that the opening organ is lifted from the surface, so that fiber flocks can be opened in one direction. The increase in performance, however, is itself a little problematical in the latter case with a rapid return passage, as according to the length of the row of bales, a time interval must be taken into account, during which no fiber flocks are opened.

A further means of increasing the performance exists, as is known, by increasing the length of the rollers. This is possible with opening organs which have either a single roller or two rollers. The disadvantage of such a measure exists, however, in the broad working range of the stand holding the opening organ, which results in a higher mechanical load of the entire system.

It would be desirable to increase, independently of the length of the opening rollers, the opening performance achieved in horizontal opening accordingly to DE-33 34 222 or inclined opening according to DE-GM-87 12 308.

SUMMARY OF THE INVENTION

In accordance with the present invention, there is provided a bale opener system in which the bale opener head which moves across the tops of a row of fiber bales has at least two opening rollers located at different levels relative to the top surface of the bales. The arrangement is such that one roller is in front of the other in the direction of movement of the head during a fiber-removing passage of the head across the tops of the fiber bales.

In a preferred form, the invention envisions that the trailing roller will be farther below the top surface of the bales than the leading roller during each fiber removing passage of the head across the row of bales. It is also preferred that the positions of the rollers be adjustable.

The invention yields a number of advantages. On the one hand, through the different penetration depths of the rollers, both rollers can utilize the full opening depth, so that with a two-roller arrangement, an effective doubling of the opening performance results. On another hand, an equivalent opening performance of smaller flocks can be opened with one roller, as it is known that the flock size increases with the increasing penetration depth per passage, which is not always desirable. In other words, with a double or multiple arrangement of rollers as opposed to a single roller arrangement, double or multiple performance can be obtained with the same penetration depth. Also, the possibility exists that, with a given performance, the flock size can be reduced by reducing the penetration depth.

A further disadvantage of the adjustable position of the rollers exists in the fact that, with simultaneous upwards or respectively downwards movements of the opening device during the forward movement along the row of bales, opening can also be quite simple in the oblique position, also without different penetration depths of the rollers. It is not absolutely necessary that both rollers rotate in the same sense. Rather, when the aforesaid performance increase or reduction of the flock size is not required, the rollers can rotate in two different senses in order to avoid reversing the rollers when the direction of movement of the opening head itself is changed as the head moves back and forth over the tops of the bales.

BRIEF DESCRIPTION OF THE DRAWINGS

The invention will now be explained in greater detail with reference to the following drawings illustrating exemplary embodiments.

DETAILED DESCRIPTION OF THE PREFERRED EMBODIMENTS

Figure 2:
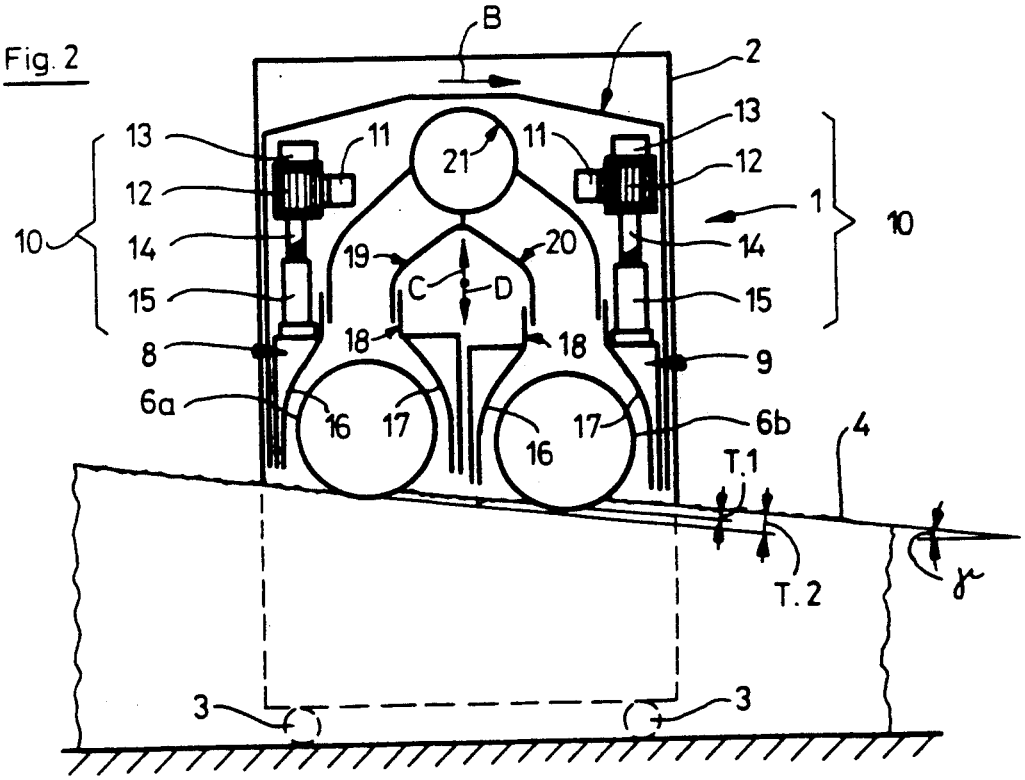
FIG. 2 is a view similar to FIG. 1, showing an arrangement which would be used during movement of the opener head of FIG. 1 in a direction opposite to the direction of movement indicated in FIG. 1.
Figure 3:
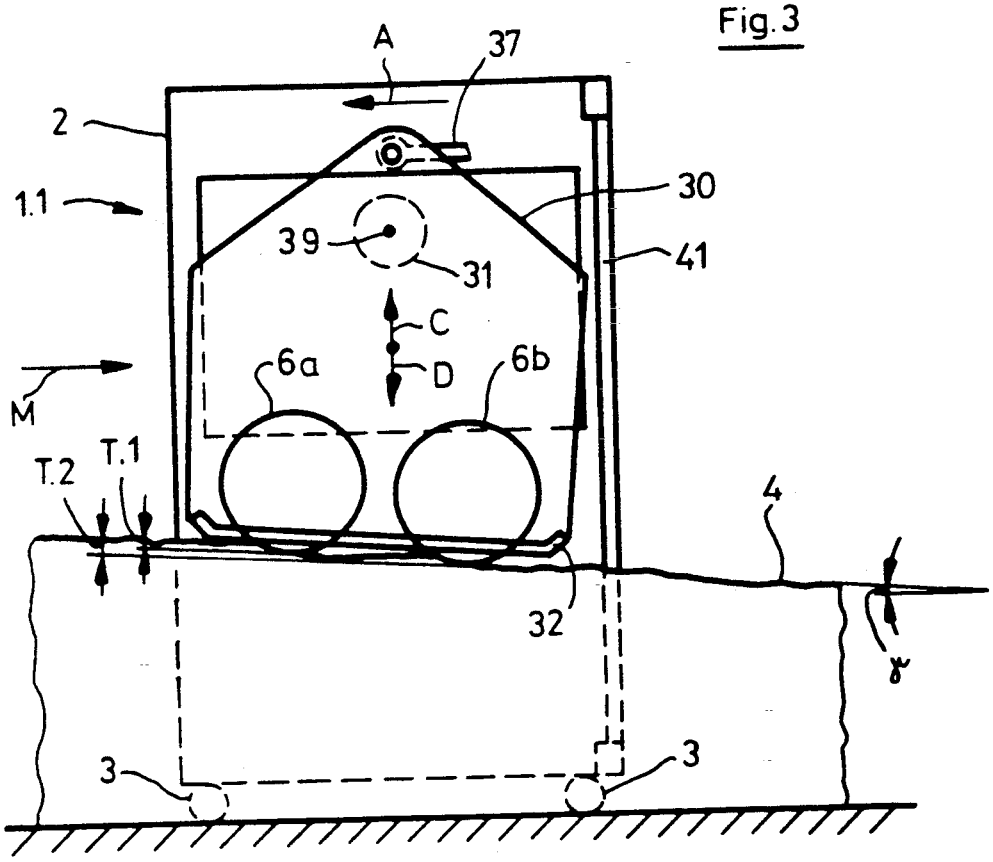
FIG. 3 shows an opening device with a further opening head or organ according to the invention, likewise represented schematically and in elevation.

An opening machine or apparatus 1 for the opening of fiber flocks comprises a stand 2 which moves back and forth by means of wheels along a row of bales 4, first in the indicated direction A and then in FIG. 2 in the indicated direction B. There is an opening head or organ 5 on guide rails (not shown) on the stand 2 which is arranged to move upwards and downwards corresponding to the arrows C and D.

Figure 5:
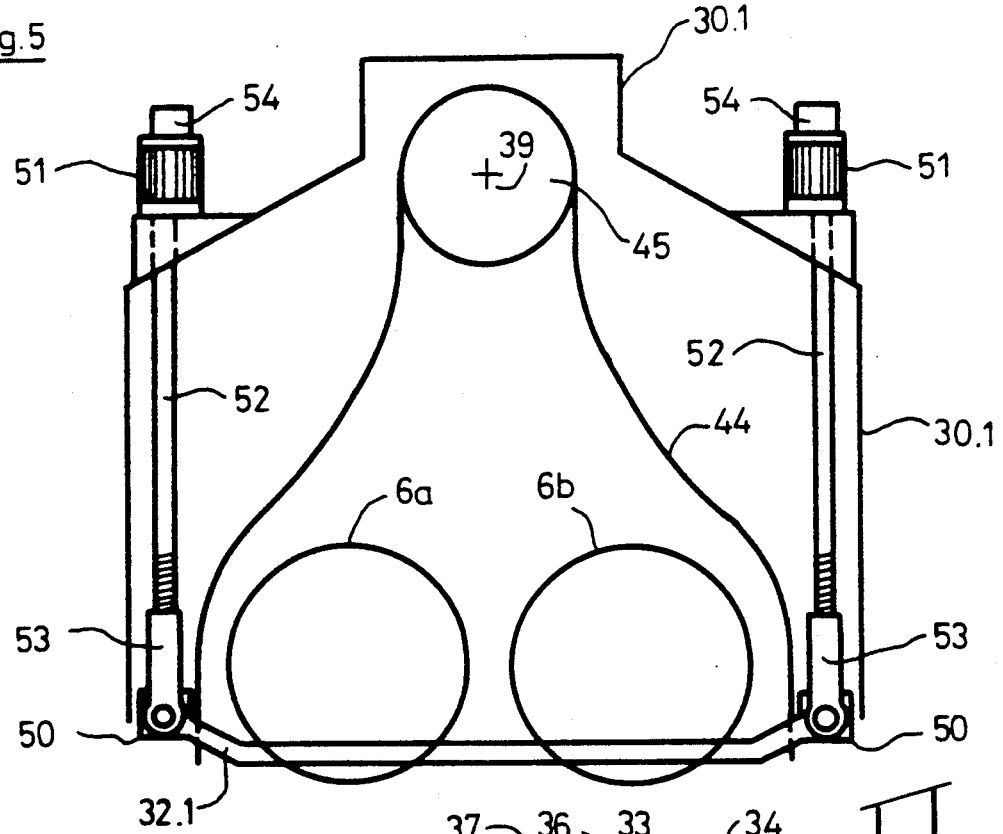
FIG. 5 is a further opening organ of an opening device according to the invention, shown half schematically and in elevation.

The opening organ 5 has two rotating opening rollers 6*a* and 6*b*, which, for example are known from the European Patent Application 00 58 781, corresponding to U.S. Pat. No. 4,457,058, the disclosure of which is incorporated herein by reference in its entirety. It is known from the patent application that these opening rollers consist of toothed discs arranged next to other in rows with spaces between the discs and that grate bars 7 (see FIG. 11) are provided in the spaces. The grate bars are either movable as shown in FIG. 5 or arranged rigidly as in FIG. 6. The fastening of the grate bars is explained later.

The opening rollers 6*a* and 6*b* are arranged to pivot and be driven in roller carriers 8 and 9 respectively.

Figure 1:
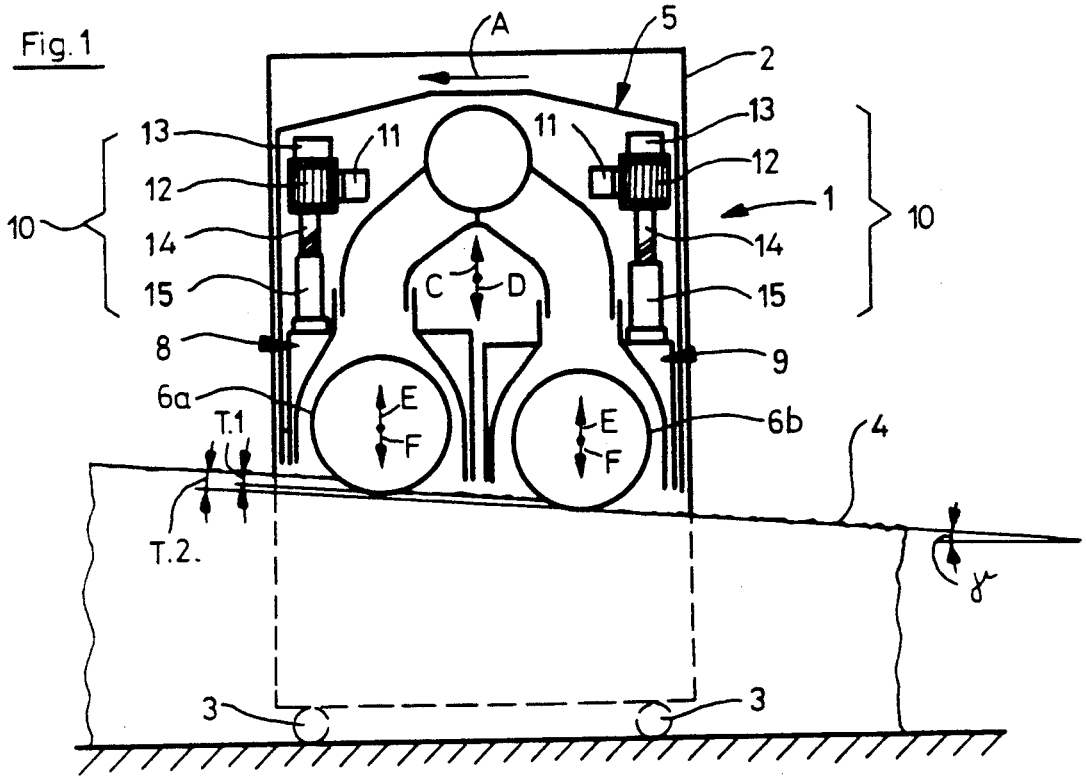
FIG. 1 is a semi-schematic elevational representation of apparatus according to the invention.

These roller carriers 8 and 9 are, for their part, guided to move upwards and downwards in the opening organ 5 by means of slides (not shown) in accordance with the directions of the arrow E and F. This movement is carried out by means of a servo-motor drive 10 (FIGS. 1 and 2). A drive if this type consists of a geared motor 12 fastened on the opening organ 5 by means of a bracket 11 (FIG. 1) with a rotation pulse transmitter 13. The output shaft of the geared motor is a spindle 14, which is led into spindle tube 15. The spindle tube, for its part, is fastened to the roller carriers 8 and 9 respectively. Each of the roller carriers 8 and 9 includes guide plates 16 and 17 (FIG. 2) which, as seen from the fixtures, open out in an outlet channel 18. The outlet channels are engaged by suction channels 19 and 20 with a minimum of free play between the respective suction channel and outlet channel. The outlet channels 18 as well as the suction channel 19 and 20 extend at least over the entire length of the opening rollers 6*a* and 6*b* so that they cover these opening rollers.

The suction channels 19 and 20 are connected to a suction pipe 21, which, for its part, is connected to a source of subatmospheric pressure in order to produce the necessary current of delivery air in the region of the opening rollers for sucking out the fiber flocks. The suction pipe widens increasingly for this purpose, namely in such a way that this has an increasingly larger cross section in the direction of the under pressure producer, in order to suck out a substantially constant quantity of air over the whole length of the opening rollers. The under pressure source is a fan (not shown) and is in itself known in practice and is therefore not more closely described here.

As a variant, the opening organ can be altered in such a way that the whole of the opening organ is not movable upwards and downwards but only the roller carriers 8 and 9. In accordance with this, the outlet channel 18 and the suction channel 19 and 20 must produce in a telescopic form and the spindle 14 must have a corresponding extension. The opening organ 5 would be statically arranged in a variant of this kind.

In the case of the variant, grate bars 7 are components of the roller carriers 8 and 9. These grate bars can be rigidly fastened in FIG. 2, or can be fastened as shown in FIG. 5.

FIGS. 3, 4, 6 and 7 show a variant according to the invention which has the same elements and reference symbols as FIGS. 1 and 2. These variants show opener devices provided with a pivotable opening organ 30 in which the driven opening rollers 6*a* and 6*b* are statically arranged. That is, the axes of the opening rollers are fixed with reference to the opening organ 30.

Figure 7:
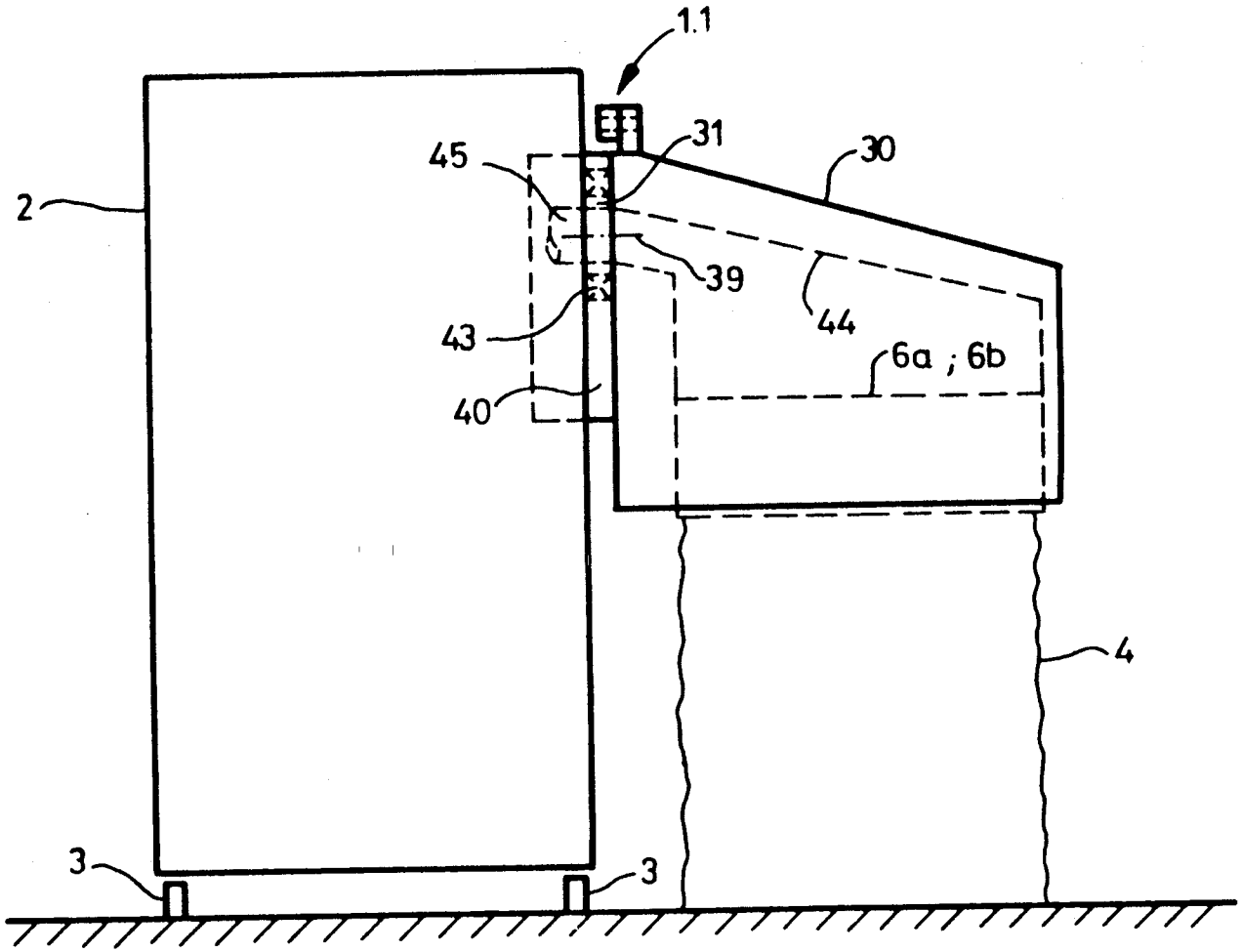
FIG. 7 is a view of the opening device of FIGS. 3 and 4, as seen in the line of sight M (FIG. 3) and representing additional details.

The opening organ 30 is pivoted as a whole on a hollow swivel axle 31, which rotates around an axis of rotation 39. The swivel axle 31 is accommodated in a pivot bearing 40 (FIG. 7). The means of moving the sliding carriage 40 up and down are described in the EP Application No. 193 647.

Figure 6:
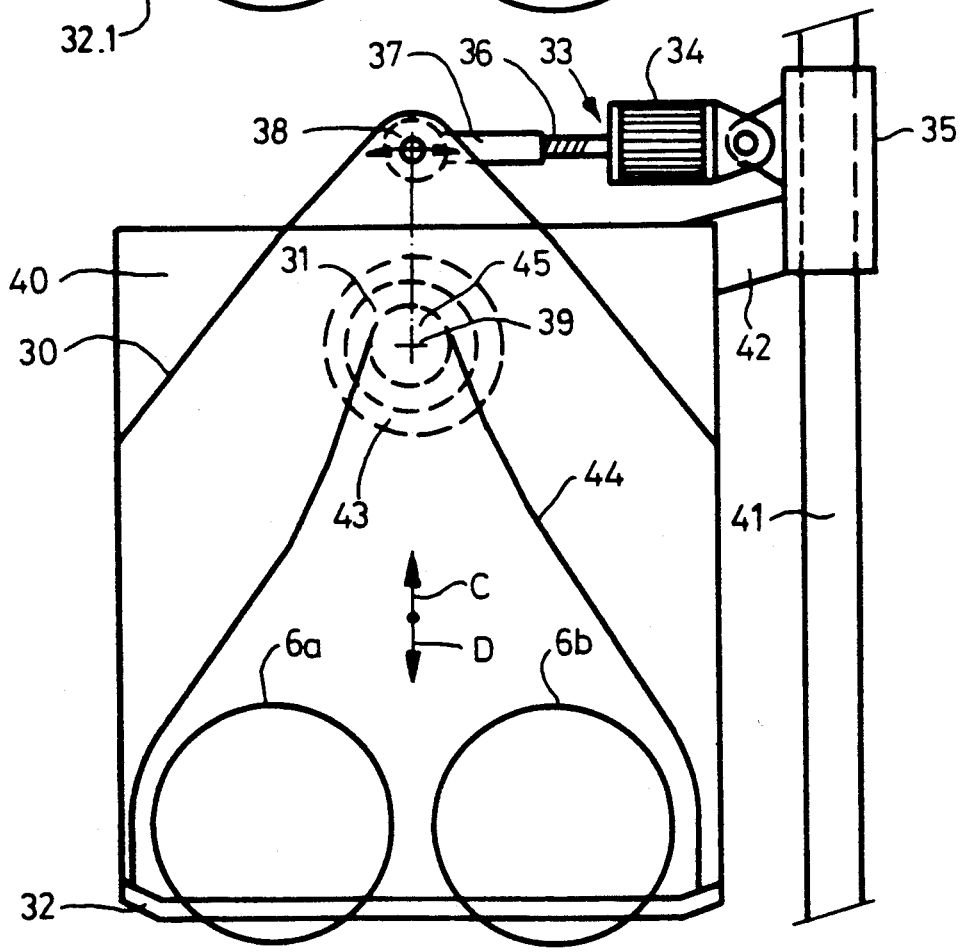
FIG. 6 is a somewhat schematic view illustrated on an enlarged scale features of an opening organ adjustable by the principle revealed in the opening device of FIGS. 3 to 4.

Further, grate bars 32 are provided either in the way shown in FIG. 5 or in the way shown in FIG. 6.

The swiveling of the opening organ 30 on the axis 39 is effected by means of a servo-motor drive 33 (FIG. 6). This comprises a geared motor 34, which is fastened to pivot with the opening organ on a sliding element 35 which moves upwards and downwards corresponding to the direction of movement C and D. This is effected through a statically arranged guide tube 41. The sliding element 35 is moved in the aforesaid directions through a connection piece 42 rigidly connected to both the sliding element 35 and the movable carriage 40. Further, the output shaft of the geared motor is envisaged as a spindle 36, which is led into a spindle tube 37. For its part, the spindle tube is fastened to swivel on the opening organ 30 by means of a pivot bearing 38.

Further, the opening organ 30 comprises one or more air guiding shafts for the delivery current of air for guiding the fiber flocks, which corresponding to its functions, stretches over the whole length of the opening rollers 6*a* and 6*b* and is connected with a suction pipe 45 connected to a source of sub-atmospheric pressure for producing the desired air currents for carrying away the fiber flocks removed by the teeth of the rollers 6*a* and 6*b*.

FIG. 5 show a further variant of the arrangement of details shown in the European Patent Application No. 01 99 041 corresponding to U.S. Pat. No. 4,707,888, which are arranged to be movable, so that, in connection with FIG. 5, only the important characteristics are repeated with new reference symbols. Further, the corresponding elements of FIG. 6 are provided with the same reference symbols.

From the European Patent Application 01 99 041 corresponding to U.S. Pat. No. 4,707,888, adjustable grate bars are already known, which are movable relatively to the position of the opening rollers, which is the reason why the variant shown in FIG. 5 is not explained here with all the details. It will suffice here to note that there are a plurality of the grate bars 32.1 spaced apart from one another along the axial length of the rollers 6*a* and 6*b* with fiber-engaging elements (e.g. teeth) from the surfaces of the rollers projecting through the spaces between adjacent grid bars 32.1 to engage the fibers of the bales over which the opener head is reciprocated. Each grate bar 32.1 is connected at its ends to adjustable means operable by pulse motors 51 to shift the respective ends up or down as desired to vary the depth of penetration of the opening roller teeth below the grate bars and thereby to adjust the opening action of the teeth.

The grate bars 32.1 shown in FIG. 5 are fastened in longitudinal carriers 50, which, for their part, are movable relatively to the opening rollers 6*a* and 6*b* by means of a swiveling hoisting mechanism fastened to it. The hoisting mechanism comprises the geared stop motors 51 in the aforesaid European patent application as well as the threaded spindles 52.

The spindles 52 are entered into the spindle tubes 53, which are connected to swivel with the longitudinal carriers 50. As can be further seen from the European Patent Application 01 99 041, there are two hoisting mechanisms provided per longitudinal carrier 50. Correspondingly, the geared stop motors are equipped with the rotation pulse transmitters 54, with which the position of the opening grate 32.1 can be specified in a control unit (not shown). Such control units are known in themselves.

Further, it should be explained once more that the opening organ 30.1 of FIG. 5 can be provided with the swiveling mechanism shown in FIG. 6 and can pivot on the axis 39 in the same way.

Various operating variants are shown in FIGS. 7 to 10, which can be embodied with the devices previously shown.

Figure 8:
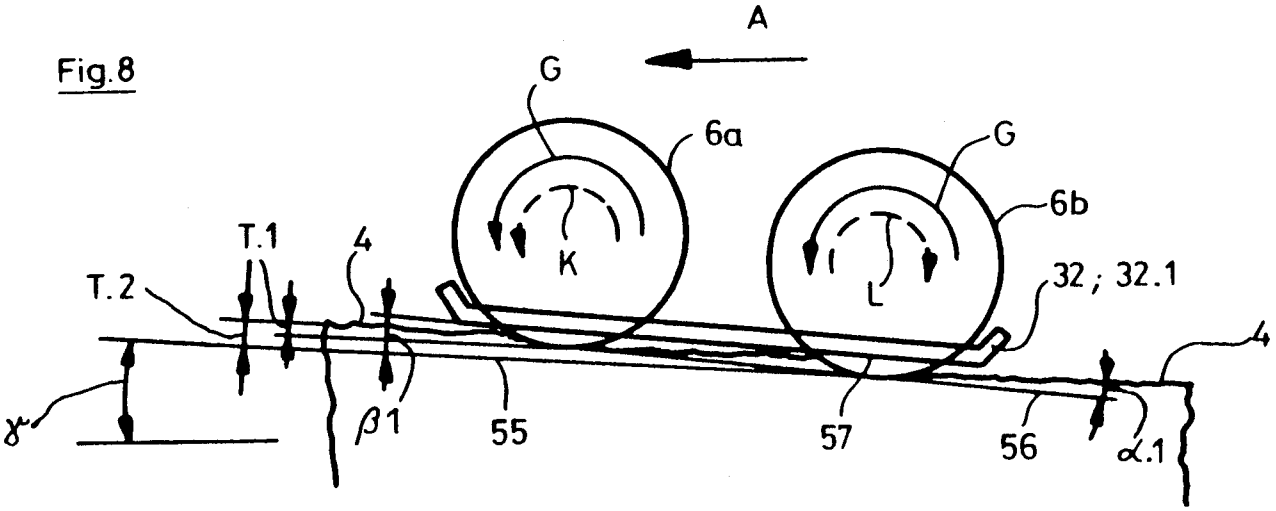
FIGS. 8–11 are schematic representations of the embodiment steps of the method according to the invention.
Figure 9:
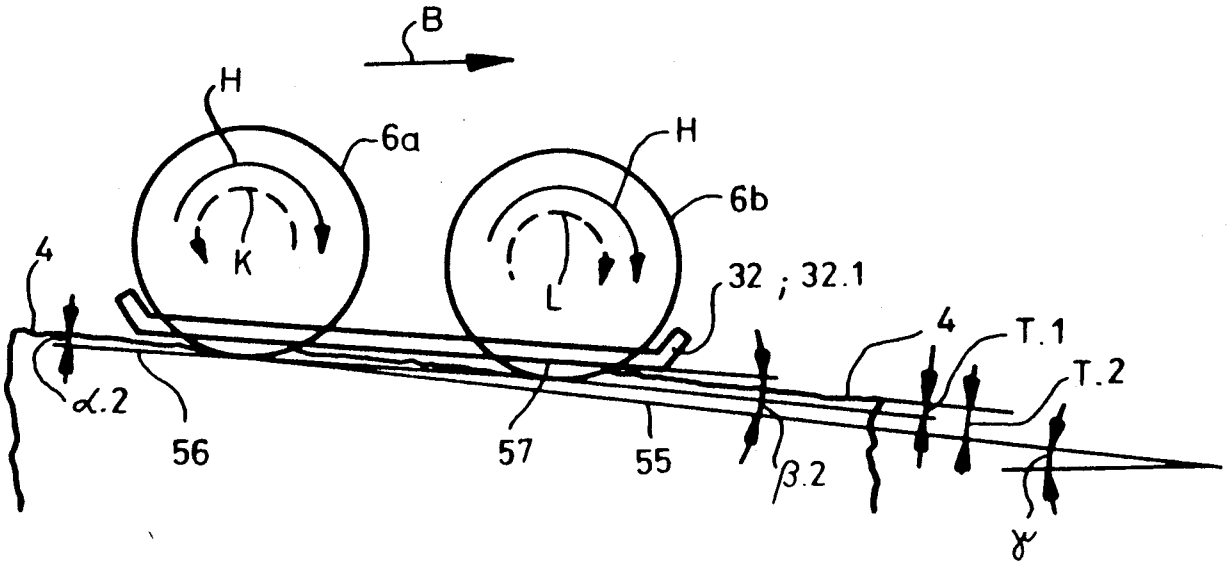

FIGS. 8 and 9 show the application possibilities of the opening organs 30 (FIG. 6) and 30.1 (FIG. 5).

Figure 4:
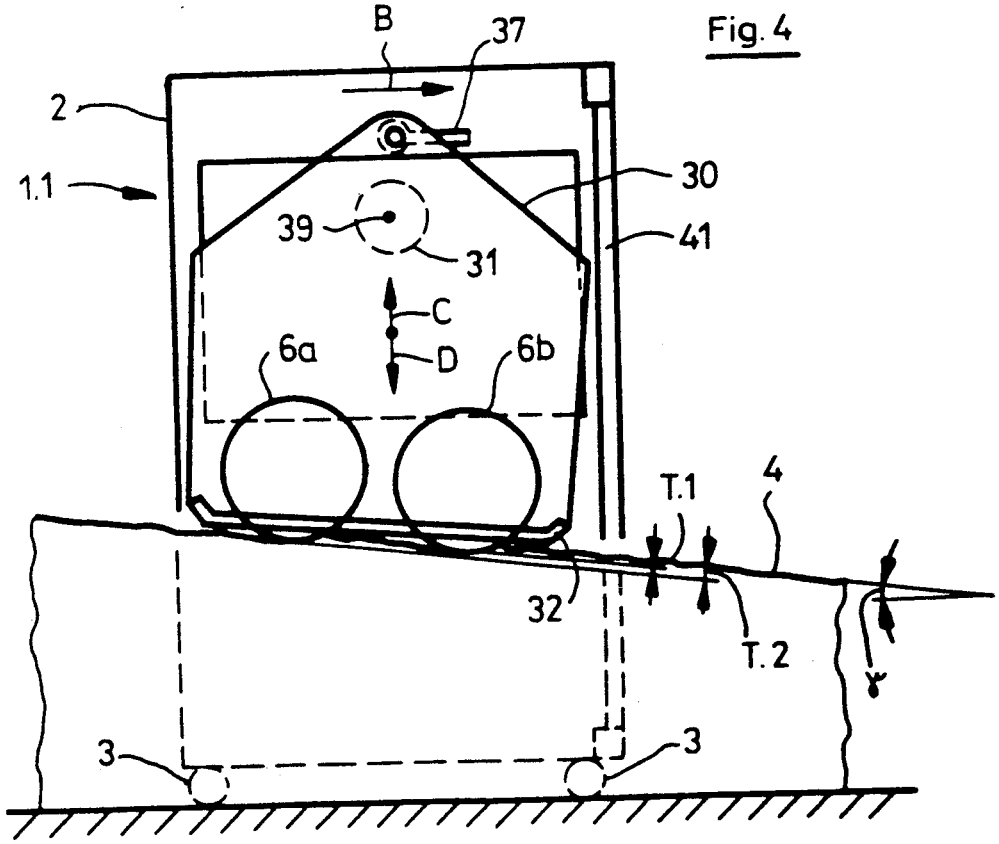
FIG. 4 is the device from FIG. 3, showing a direction of movement opposite to the direction shown in FIG. 1.

IN the case of the use of the opening organ 30, the angle $\alpha.1$ resulting from the swiveling relative to the surface of the fiber bales 4 of this opening organ of the opening rollers 6*a* and 6*b* has the same size as the angle of $\beta 1$ of the grate bars 32. The angle $\alpha.1$ is formed by an imaginary plane 56 adjacent to the periphery of the opening rollers 6*a* and 6*b* and an imaginary plane 55 lying parallel to the surface of the bales. The angle $\beta 1$ is formed the plane 55 and an imaginary plane 57 containing the lower part of the grate bar surfaces pressing into the surface of the bales. The angle $\beta.1$ is so selected that the penetration depth T.1 of the opening roller 6*a* is about half as large as the penetration depth T.2 of the opening roller 6*b*. The "penetration depth" is taken here to mean the measure of the penetration of the relative opening organ in relation to the bale surface in front of the opening organ 30. That is, one ascertains the perpendicular distance between (1) a plane containing the bale tops located in front (in the direction of movement of the opening head) of the opening head and (2) a parallel plane tangent to the lowermost teeth on the opening roll (6*a* or 6*b*) under consideration. This distance is the "penetration depth." This holds good whether the stand is moving direction A (FIG. 3) or in direction B (FIGS. 4 and 9).

FIG. 9 shows the situation which is caused to prevail when the opening head or organ is moved in the opposite direction of movement B. Instead of being designated as $\alpha.1$, the angle here is designated by the character $\alpha.2$; and instead of $\beta 1$, the angle is designated with $\beta.2$. The angle $\alpha.1$ is exactly the same size as $\alpha.2$ and $\beta 1$ is the same size as $\beta.2$. It is also possible to operate the opening organ (i.e. already described organs 5 or 30, or the opening organs 30.1, 30.2, 30.3 and 30.4 to be described later), in such a way that angle $\alpha$ =angle $\beta$ and the penetration depth T.1=T.2, for example, if the opening rollers 6*a* and 6*b* are rotating in the opposite sense K, L.

At this point, ti will be helpful to summarize in illustrative preferred sequence of operations of the bale opener with reference to FIGS. 8 and 9.

As noted earlier the bale opener head moves linearly back and forth over the row of vales. 4. At the right end of the row, the level of the blade opener head will be lowered for the fiber removing movement in the direction A. Also, the levels of the rollers 6*a* and 6*b* and their directions of rotation, will be set for this next movement (i.e. The movement in the direction A in FIG. 8). The levels of the rollers 6*a* and 6*b* relative to each other will be set as indicated in FIG. 8, with the penetration depth for the roller 6*a* being about one-half the penetration depth for the roller 6*b*. Also, the directions of rotation of both rollers would be set to correspond with the arrows G in FIG. 8, so that the teeth on each of the rollers contact the bale surfaces with a motion having a component in a direction opposite to the linear direction A of movement of the opener head. Thus, each of the rollers moves in synchronism with the direction of movement of the head to assure a preferred type of action on the fibers.

After the head has completed its linear movement in the direction A over the row of fiber bales 4, the head as a whole is lowered to position it for proper fiber removal during its next pass over the tops of the fiber bales in the direction B. At this time the positions of the rollers 6*a* and 6*b* are changed so that the penetration depth of the roller 6*b* will be about one-half the penetration depth of the roller and 6*a* as the head moves back across the fiber bales in the direction B. Additionally, the directions of rotation of the rollers 6*a* and 6*b* are reversed to the direction indicated by the arrow H in FIG. 9. Again the result is to cause the rollers to move in synchronism with the direction of linear movement of the head on the stroke B so as to effect the desired type of coaction between the teeth on the rollers and the fibers of the bales. After the proper settings have been achieved, the head as a whole then is moved entirely across the row of bales 4 in the direction B to complete the cycle.

Of course, the cycle may be the same whether the apparatus is set up for operating upon bale tops that are located in generally the shame horizontal plane or on bale tops located at an inclined angle. The latter arrangement is indicated in FIGS. 8 and 9, but the same principles for the cycle apply in connection with situations where the head moves horizontally across the tops of the bales.

In a variant which is likewise possible, if the suspension of the grate bars 32.1 of FIG. 5 is combined with a swiveling opening organ, according to the opening organ 30 of the FIG. 6, then the possibility exists of selecting different values for the angles $\alpha$.1 and $\beta$.2 and for the angles $\beta$1 and $\beta$.2 (FIG. 8).

It is shown with the direction arrow G and the direction of movement A (FIG. 8) that the opening rollers rotate in synchronism with the direction of movement A. That is, the fiber engaging elements or teeth at the bottom portion of the opening rollers 61 and 6*b* will, by reason of the direction of rotation G, have a component of motion in a direction opposite to the direction A of linear movement of the opening head or organ as a whole over the tops of the fiber bales in the row. The same relationship of synchronism prevails in FIG. 9 where the linear direction has been reversed to B and the direction of roller rotation has been reversed to H. On the other hand, if the opening rollers 6*a* and 6*b* rotate in the senses K and L, the opening roller 6*a* rotates in synchronism in the case shown in FIG. 8 and the opening 6*a* counter-rotates.

Figure 10:
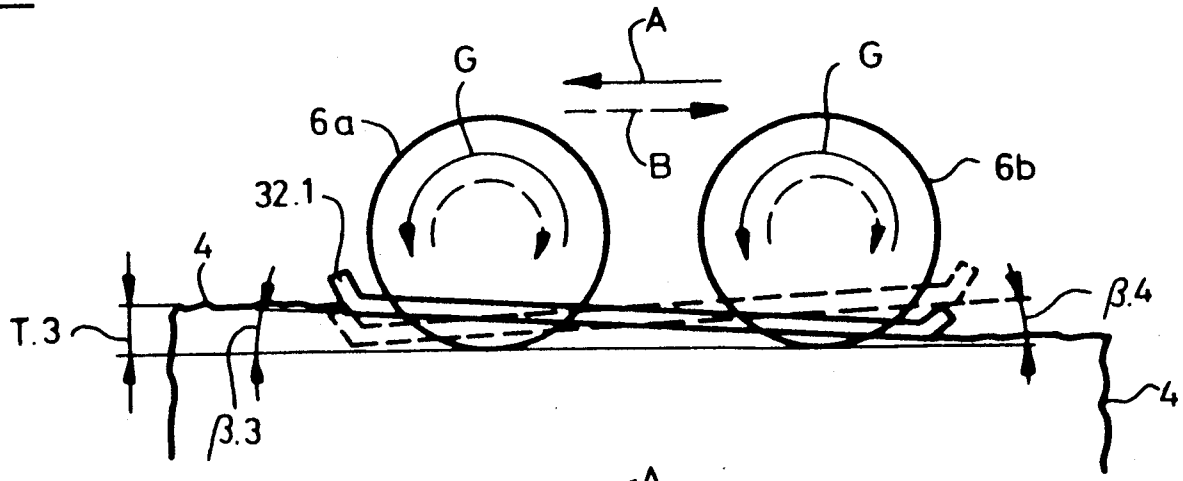

FIG. 10 shows an example with the use of the opening organ 30.1, without a swiveling mechanism. It presents rather a possibility of an adjustment of the grate bars 32.1, so that the difference of the penetration depth T.3 between the opening roller 6*a* and the opening roller 6*b* is produced through the adjustment of the grate bars 32.1 wit the angle $\beta$.3 for the direction of movement A and with the angle $\beta$.4 for the direction of movement B. Hence, the directions of movement G and H or K and L can be selected.

Figure 11:
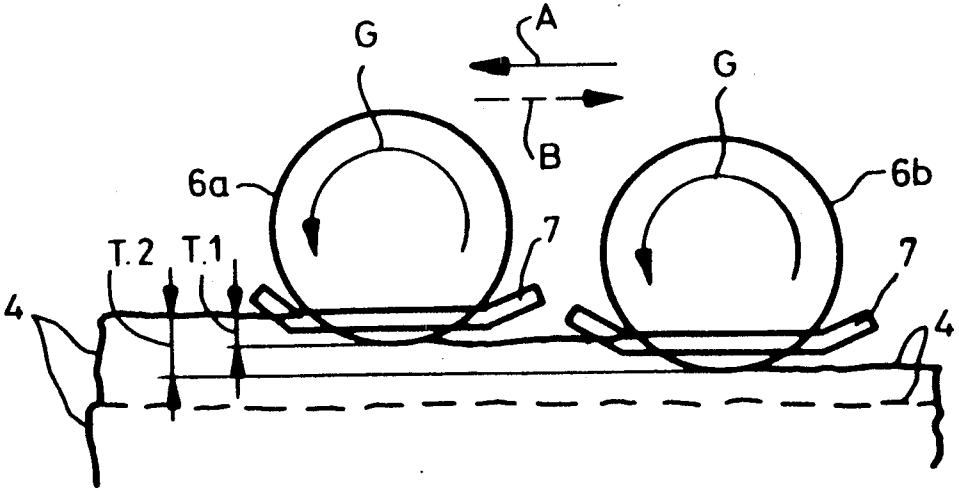

FIG. 11 shows, for the direction of movement A only, the use of the opening organ 5 according to FIGS. 1 and 2, provided additionally with schematically represented grate bars 7. The depths of penetration T.1 and T.2 are individually selectable and can be mutually interchanged correspondingly in the direction of movement B (not shown in FIG. 10), insofar as flocks are opened in both directions of movement.

The arrow B shown with a double dashed line and the row of fiber bales shown with a dashed line indicates a variant which is possible with all the opening organs, namely that on the return travel the opening organs (5 or 30 or 30.1) are lifted from the surface of the bales and always have the same inclined position. In this way, fiber flocks are only opened from the bales in the direction A. This variant can also be used when it is intended to open the blend within the rows of bales from the same side always. A permanently inclined position of the opening rollers can also be selected.

Figure 12:
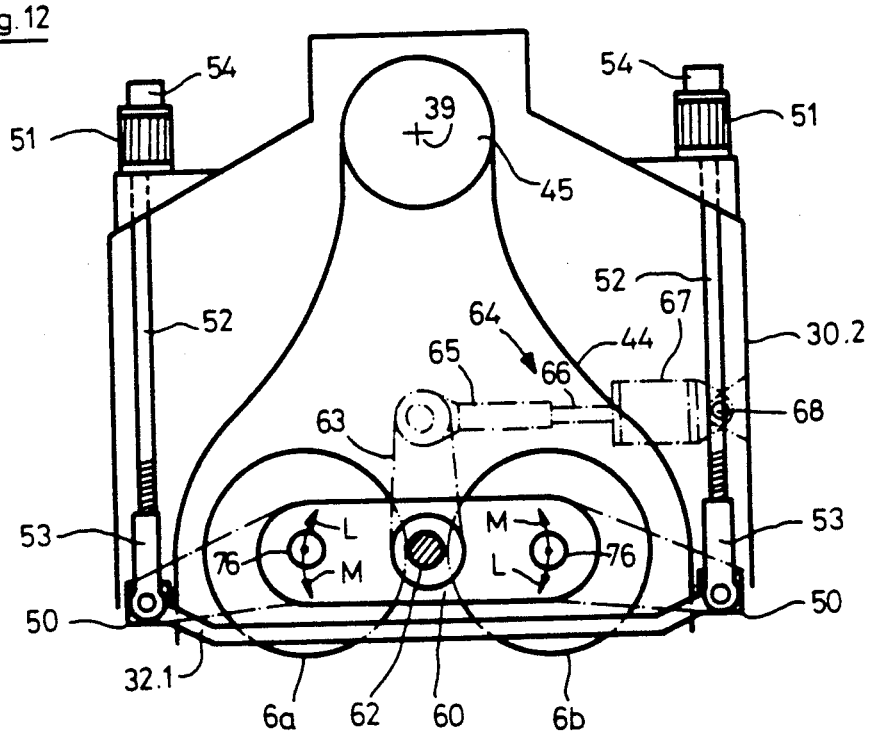
FIG. 12 is an opening organ according to the invention, represented half schematically.

FIG. 12 shows an opening organ 30.2 in which the adjustable grate bars 32.1 are arranged to adjust in the same way as in FIG. 5, which is the reason why the same elements are designated with the same reference symbols as in FIG. 5. Further, the same or similar elements are designed with the same reference symbols as in FIG. 5.

Figure 13:
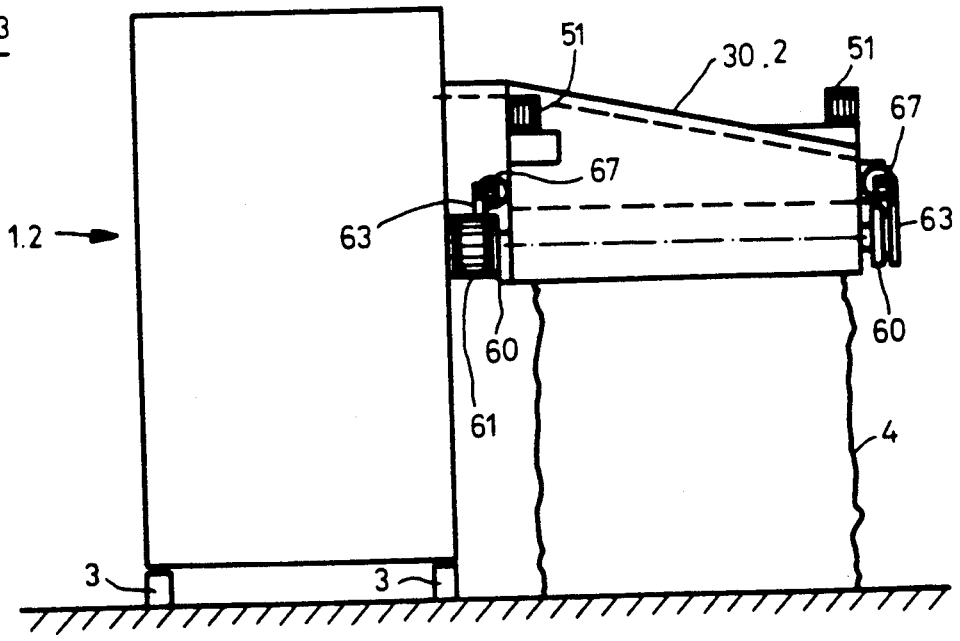
FIG. 13 is an opening device with the opening device from FIG. 12, seen in the line of sight M (FIG. 12)

In these variants, the possibility exists for moving the opening rollers 6*a* and 6*b* for inclined opening according to the angle $\gamma$ shown in FIGS. 1 to 4 as well as for opening with different penetration depths T.1 and T.2, likewise shown in FIGS. 1 to 4 by means of movements of rocking shafts 62 in the directions L and M. In addition, the opening rollers are each supported to pivot and be driven in bearing carries 60 (only one being shown in FIG. 12) by means or motors 61 (FIG. 13). The bearing carriers 60, for their part, are supported to swivel in the middle analogous to balance beams, each in accordance with the two rocking shafts 62 so that the opening rollers 6*a* and 6*b* pivot in synchronism in the direction of the arrow L or M by means of the rocking shafts 62. Thereby, the bearing carriers 60 are arranged rigidly on the appropriate rocking shaft.

The rocking shafts 62, for their part, are each supported to rotate in a casing of the opening organ 30.2, secured against axial displacement and each is rigidly connected with a swivel arm 63 (indicated with a dash-dotted line in FIG. 12). Each swivel arm 63, for its part, is connected with a movement mechanism 64, which comprises a spindle tube 65 swiveling with the swivel arm 63, a spindle 66 introduced into this and a stepping motor 67 driving this spindle. For its part, the stepping motor is connected to swivel with the casing of the opening roller 30.2 by means of the swiveling axis 68.

In addition to the swiveling of the opening rollers 6*a* and 6*b* by means of the rocking shafts 62, the grate bars 32.1 can likewise by moved on one side or downwards or upwards on both sides with the device already shown for FIG. 5, with reference to FIG. 12, or raised or lowered by means of the spindle 52, so that the position of the grate bars 32.1 can be suited to the position of the opening rollers 6*a* and 6*b* according to requirements.

The stepping motor 67 functions correspondingly to the stepping motors 34 and 51, this means, it is equipped, as is known in itself, to determine the exact position of the opening rollers 6*a* and 6*b* according to the control unit (not shown).

Figure 14:
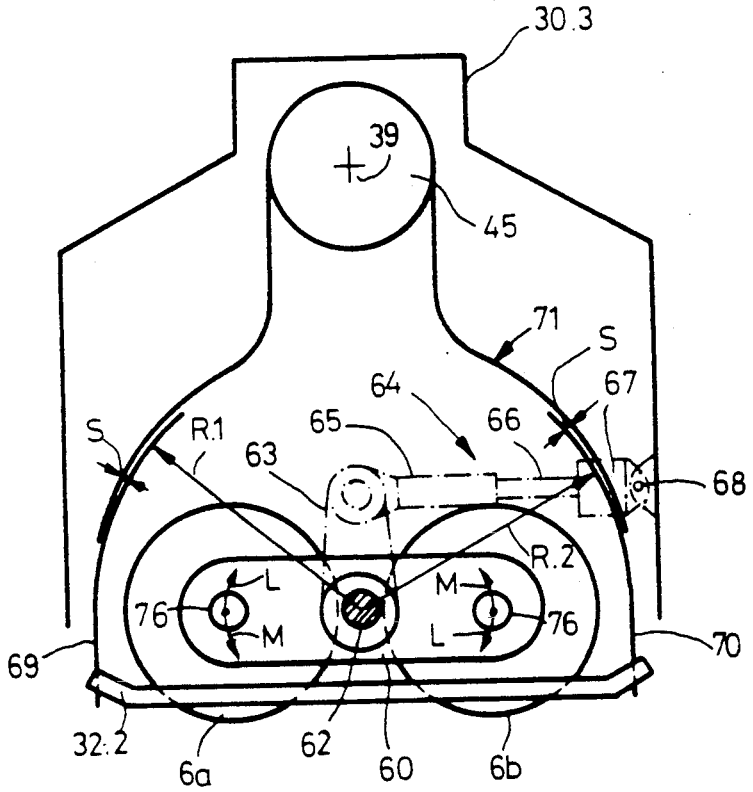
FIG. 14 is an opening organ according to the invention, represented half schematically.

FIG. 14 shows the same swiveling functions of the opening rollers 6*a* and 6*b* with the same elements, which is the reason why the same elements are designated with the same reference symbols and therefore not described again.

In comparison with the device of FIG. 13, the grate bars 32.2 are fastened on side walls 69 and 70, which for their part, are connected with the bearing carriers 60 (not shown), so that the side walls 69 and 70 can be swiveled in the swiveling directions L and M at the same time as the bearing carrier 60 and also with the grate bars 32.2.

The side walls 69 and 70 are each connected on both of the front ends of the opening rollers 6a and 6b with front plates (not shown), so that the side walls 69 and 70 form a channel with the side walls round the opening rollers 6a and 6b.

As can be seen from FIG. 14, this channel is covered by a suction channel 71, which for its own part, branches into the suction pipe 39.

So that the channel formed through the sidewalls 69 and 70 within the covering channel 71 can be swiveled in the swiveling direction L and M, the side walls 69 and 70 are curve shaped according to the radii R.1 and R.2. Thereby, the radii R.1 and R.2 coincide in the axis (not shown) of the swiveling axis 62. Likewise, as can been seen from FIG. 14, the covering channel 71 is adapted with regard to the curved shape of the side walls 69 and 70 and is only so much greater than the channel located underneath as to leave a gap of width S, approximately 1 millimeter in each case, between the side walls 69 and 70 and the walls of the' covering channel 71.

This gap can be selected to be greater or smaller according to requirements, as the soc-called infiltrated air is sucked in through this gap, which, however, under certain circumstances, can serve for the conveyance of the fiber flocks in the channel 71. In any case, the gap S should be at least great enough to ensure that the side walls 69 and 70 do not rub on the inner wall of the covering channel 71.

Figure 15:
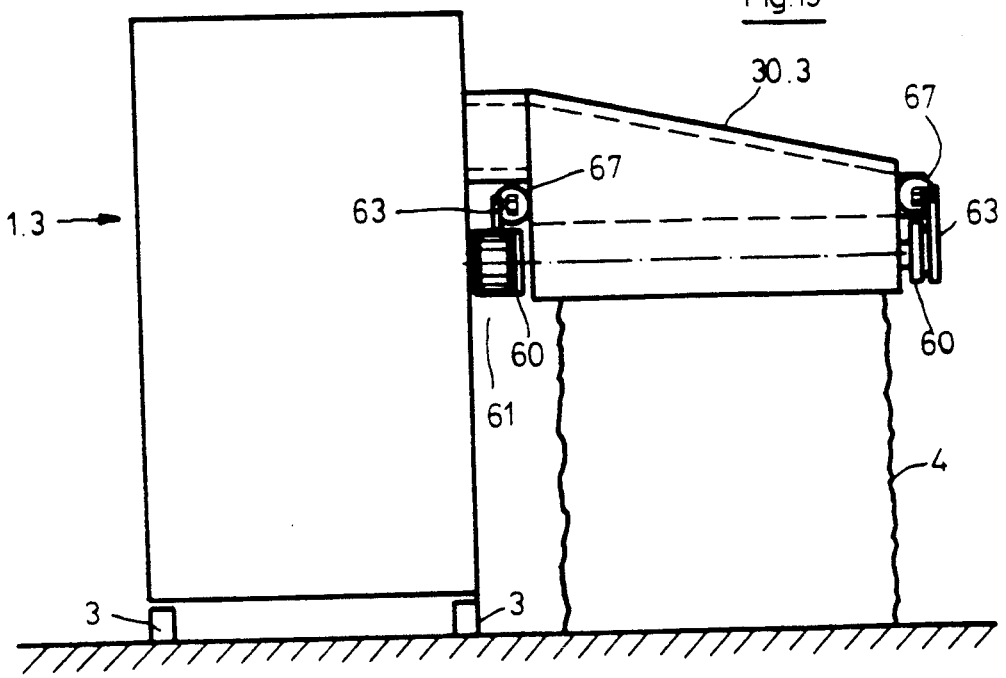
FIG. 15 is a view of an opening device with the opening organ from FIG. 14, as seen in the line of sight M (FIG. 14)

FIG. 15 shows the two ends of the bearing carriers provided for the opening rollers 6a and 6b as well as the motor 61 provided for each roller.

Instead of one motor for each opening roller, one common motor only can be provided, whereby, in such a case, an upper drive must be provided between the two opening rollers.

Figure 16:
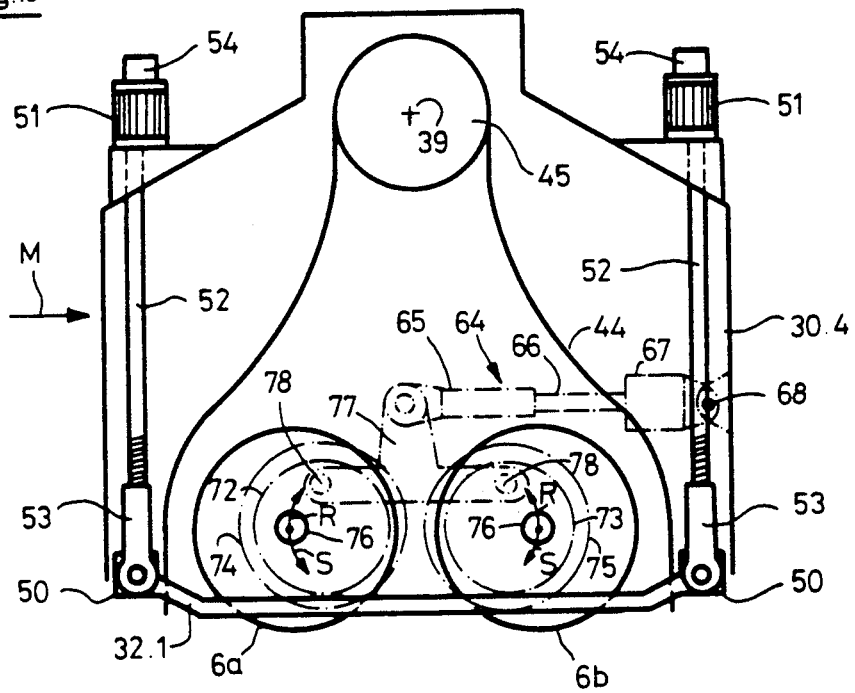
FIG. 16 is another opening organ according to the invention, represented half schematically.
Figure 17:
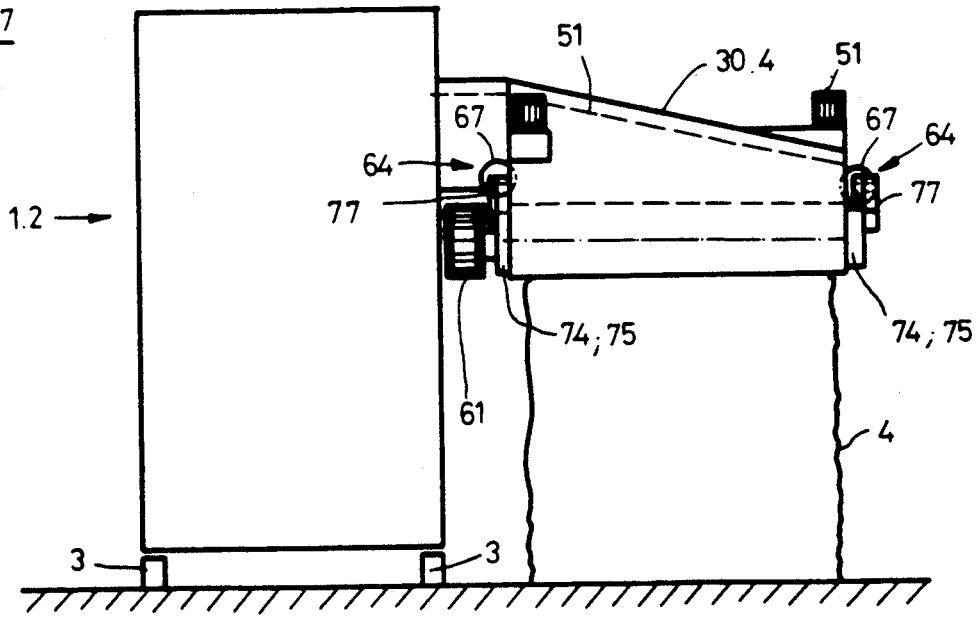
FIG. 17 is an opening device, with the opening organ of from FIG. 16, as seen in the line of sign M (FIG. 16).

FIGS. 16 and 17 show a further variant of the feasibility of arranging the opening rollers 6a and 6b so that they can be adjusted for the soc-called inclined opening described.

In addition, the shaft 76 of the opening roller 6a is supported on its two ends, each in an eccentric bearing 72, to pivot and be driven and the shaft 76 of the opening roller 6b is supported on its two ends, each in an eccentric bearing 73, to pivot and be driven.

The eccentric bearings 72 are supported to pivot in a bearing shell 74 and the eccentric bearings 73 are supported to pivot in a bearing shell 75, whereby the bearing shells 74 and 75 are rigidly arranged on the casing of the opening organ 30.4.

In FIG. 16 only two of the eccentric bearings and bearing shells are represented by way of suggestion which chain dotted liens, while in FIG. 17 the bearing shells on both ends of the opening roller 6a are only designated by way of suggestion.

As can be seen from FIG. 17, not only the eccentric bearings and the bearing shells each provided on both ends of the opening rollers 6a and 6b are envisaged, but also the device 64 with the stepping motor 67, already described in FIGS. 12 to 15.

The movement device 64, as is known, comprises the spindle tube 65, which is connected to swivel with a connecting rod 77 in this variant.

The connecting rod 77 for its part is connected to swivel with the eccentric bearings 72 and 73 by means of the swivel pins 78.

Through this movement mechanism and the connection of the eccentric bearings 72 and 73 through the connecting rod 77, the opening rollers 6a and 6b are moved with the actuation of the stepping motor 67, either upwards in the direction of the arrow R, or downwards in the direction of the arrow S. Thereby it is so, that corresponding to the arrangement of the eccentric bearings 72 and 73, when the opening roller 6a is moved upwards in the direction R, the opening roller 6b is moved downwards by the same amount, so that, with this device also, with the opening of the surface of the bale, the opening rollers can be set in such a way that they can be operated with the same or different penetration depths for the inclined opening according to the angle $\gamma$.

Further, the invention idea in this application can be combined with inventive idea shown in the European Patent Application No. 01 93 647 corresponding to U.S. Pat. No. 4,660,257. In the latter application it is represented that the setting depth of the opening organ 5 and 30, respectively 30.1, 30.2, 30.3 and 30.4 per passage alters with increasing fiber bale density that means, on the one hand it is reduced in order to achieve a uniform performance and, on the other hand, to open the fiber flock from the fiber bales carefully.

This means that the penetration depths T.1 and T.2 can likewise be altered correspondingly with increasing fiber bale density. That is, the control unit (not shown) is laid out in such a way that the different densities of the fiber bales can be taken into account in the aforesaid manner because of the inclined opening surface.

Finally, the invention can also be implemented with three or more opening rollers, or the opening rollers can be used without grate bars.

In summary then, it now will be evident that various aspects, of the present invention are subject to implementation in a number of specific ways, sometimes with specifically different apparatus arrangements. The claims which follow should be read with this in mind. For additional clarity however it is noted here that presently the most preferred mode of carrying out the invention is one in which (a) the plane of the tops of the bales 4 being opened is inclined on an angle to the horizontal and the opening head moves linearly in a direction parallel to such plane; (b) each of the two rollers 6a and 6b rotates in synchronous relation to the direction of linear movement of the opening head over the bales 4, so that the fiber engaging elements at the bottom portions of both rollers have a component of motion in a direction opposite to the direction of linear movement of the head; (c) the direction so rotation of both of the opening rollers 6a and 6b are reversed to permit the desired opening of the bales to take place in both directions of movement of the head over the bale tops; (d) the adjustment of the relative positions of the rollers 6a and 6b to give the trailing roller a depth of penetration greater than that of the leading roller takes place by a swinging action (most preferably as in FIG. 3) of a mounting means for the rollers and (e) adjustable (most preferably as in FIG. 10) grate bars 57 are arranged in the spaces between the toothed discs which provide the fiber engaging elements at the surfaces of the opening rollers 6a and 6b.

WHAT IS CLAIMED IS:

1. Method for the opening of fiber flocks from fiber bales arranged in a row, by means of an opening organ moving over the fiber bales with at lest two rotating opening rollers, which are arranged next to each other as seen in the direction of the axes of the rollers and one behind the other as seen in the direction of movement of the opening organ and which are caused to penetrate into the fiber bales with a specified penetration depth for opening fiber flocks, said organ being arranged to move over the fiber bales in such a way that the opening surface forms an angle $\gamma$ with the horizontal of less than 90 degrees, characterized by the fact that the depth of penetration of the rollers relative to the surface to be opened in front of the opening roller is different.

2. Method according to claim 1, characterized by the fact that the depth of penetration of the back roller seen in the direction of motion, is greater than that of the front roller.

3. Method according to claim 1, characterized by the fact that the opening of the fiber flocks is effected by means of fiber engaging teeth arranged in rows at the surfaces of said opening rollers with spaces between the rows of teeth and that grate bars arranged in the spaces lie on the surface of the fiber bales during opening of the fiber flocks and are likewise adjustable in their positions.

4. Method according to claim 1, characterized by the fact that the penetration depth is attained by the different setting of the opening rollers relative to the surface to be opened in front of the opening organ.

5. Method according to claim 3, characterized by the fact that the different penetration depth is attained through the position of the grate bars.

6. Method according to claim 1, characterized by the fact that, seen in the direction of movement of the opening organ, the first roller rotates in synchronism with the direction of movement.

7. Apparatus for the opening of the fiber flocks from fiber bales arranged in a row, by means of an opening organ moving mover the fiber bales with at least two rotating opening rollers, which seen in the axial direction of the rollers are arranged next to each other and seen in the direction of movement of the opening organ are arranged one behind the other, whereby the opening organ can be lowered by a specified amount on every fiber opening passage in order to maintain an appropriate, specified penetration depth of the opening rollers in the surface of the bales characterized by the fact that the rollers are arranged to be adjustable, namely in such a way, that the opening surface forms an angle $\gamma$ with the horizontal which is less than 90 degrees.

8. Apparatus according to claim 7, characterized by the fact that the position of the rollers inside the opening organ can be adjusted.

9. Apparatus according to claim 7, characterized by the fact that the opening organ is arranged to swivel and adjustment of the position of the rollers is carried out through swiveling the opening organ to a specified amount and that means are provided for the swiveling the opening organ.

10. Apparatus according to claim 7, characterized by the fact that the adjustment of the rollers is moreover of such a type that the penetration depth of the rollers with regard to the surface to be opened in front of the opening organ is different.

11. Apparatus according to claim 7, characterized by the fact that the opening organ for each opening roller is divided into individual partial opening organs each of which, through appropriate means, can be moved singly upwards and/or downwards by a specified amount and that the adjustment of the position can be carried out by means of the adjustment of the partial organs.

12. Apparatus according to claim 11, characterized by the fact that moreover the opening rollers are in the form of toothed disc opening rollers comprising toothed discs, which seen in the direction of rotation of the opening rollers, are arranged in rows next to each other with spaces between the toothed discs, and that grate bars are arranged in the spaces, which lie on the surface of the fiber bales when opening the fiber flocks.

13. Apparatus according to claim 12, characterized by the fact that the grate bars are arranged to be adjustable in their position in the same way as the opening rollers.

14. Apparatus according to claim 13, characterized by the fact that the grate bars on the one hand are adjustable according to the adjustment in position of the rollers and, on the other hand, are additionally adjustable through their own means.

15. Apparatus according to claim 7, characterized by the fact that the opening rollers are driven in the same sense.

16. Apparatus according to claim 7, characterized by the fact that the opening rollers are driven in opposite senses.

17. Apparatus according to claim 15, characterized by the fact that the first opening roller, seen in the direction of movement of the opening organ, is driven in so-called synchronism with the direction of movement.

18. Apparatus according to claim 7, characterized by the fact that the direction of rotation of the opening rollers is reversible.

19. Apparatus according to claim 7, characterized by the fact that the opening organ can be lifted from the fiber bales for the return passage.

20. A Method of removing fiber flocks from fiber bales arranged in a row having inclined top surface through use of an opener head movable linearly back and forth over the bales generally parallel to the top surface of said row of bales and having therein a suction system and first and second opening rollers provided with fiber engaging elements for picking fiber flocks from the bales for removal by the suction system, said rollers having their axes generally parallel to one another and at right angles to the direction of movement of said head, said method comprising moving said head to a first end of its back and forth path and setting the levels of said head and each of said rollers relative to the top surface of the blades such that, upon linear movement of said head, fiber engaging elements at the bottom portions of both of said rollers may contact the bales with the elements on said second roller extending farther below the top surface of said bales than the element on said first roller;

moving said head linearly to the opposite second end of its back and froth path while rotating both of said rollers about their axes in a first rotary direction to give the fiber engaging elements at the bottom portions of such rollers a component of motion in a direction opposite to the linear direction of movement of said head;

lowering said head and re-setting the levels of said rollers relative to the top surface of the blades such that, upon linear movement of said head, fiber engaging elements at the bottom portions of both of said rollers may contact the bales with the elements on said first roller extend farther below the top surface of said bales than the elements of said second roller; and moving said head linearly back to said first end of its back and forth path while rotating both of said rollers about their axes in a second rotary direction to give the fiber engaging elements at the bottom portion of such rollers a component of motion in a direction opposite to the linear direction of movement of said head.

* * * * *